US010746163B2

(12) United States Patent
Amemori et al.

(10) Patent No.: US 10,746,163 B2
(45) Date of Patent: Aug. 18, 2020

(54) VARIABLE CAPACITY COMPRESSOR

(71) Applicant: Valeo Japan Co., Ltd., Saitama (JP)

(72) Inventors: Masanori Amemori, Saitama (JP); Kentaro Suzuki, Saitama (JP); Takeshi Konishi, Saitama (JP); Changheon Ohk, Saitama (JP); Takayuki Endo, Saitama (JP); Yukio Kazahaya, Saitama (JP)

(73) Assignee: Valeo Japan Co., Ltd., Saitama (JP)

( * ) Notice: Subject to any disclaimer, the term of this patent is extended or adjusted under 35 U.S.C. 154(b) by 322 days.

(21) Appl. No.: 15/741,046

(22) PCT Filed: Jun. 28, 2016

(86) PCT No.: PCT/JP2016/069082
§ 371 (c)(1),
(2) Date: Dec. 29, 2017

(87) PCT Pub. No.: WO2017/002784
PCT Pub. Date: Jan. 5, 2017

(65) Prior Publication Data

US 2018/0187665 A1 Jul. 5, 2018

(30) Foreign Application Priority Data

Jun. 30, 2015 (JP) ..... 2015-130541

(51) Int. Cl.
*F04B 27/18* (2006.01)

(52) U.S. Cl.
CPC .. *F04B 27/1804* (2013.01); *F04B 2027/1831* (2013.01); *F04B 2027/1872* (2013.01); *F04B 2027/1881* (2013.01)

(58) Field of Classification Search
CPC . F04B 27/1804–2027/1831; F04B 2027/1863; F04B 2027/1872; F04B 2027/1881
See application file for complete search history.

(56) References Cited

U.S. PATENT DOCUMENTS 5,603,610 A * 2/1997 Kawaguchi ..... F04B 27/1804 417/222.2
5,681,150 A * 10/1997 Kawaguchi ..... F04B 27/1804 417/222.2

(Continued)

FOREIGN PATENT DOCUMENTS

EP 1375918 A1 1/2004
JP H09-228957 A 9/1997

(Continued)

OTHER PUBLICATIONS

International Search Report issued in corresponding application no. PCT/JP2016/069082 dated Sep. 20, 2016 (3 pages).

(Continued)

*Primary Examiner* — Bryan M Lettman
(74) *Attorney, Agent, or Firm* — Osha Liang LLP

(57) ABSTRACT

A variable capacity compressor includes a compression chamber that compresses a working fluid, an inlet chamber to house the working fluid to be compressed, a discharge chamber to house the working fluid compressed in the compression chamber and discharged therefrom, a control pressure chamber to house a swash plate rotating in accordance with a rotation of the drive shaft, a supply passage to facilitate communication between the discharge chamber and the control pressure chamber, a bleed passage to facilitate communication between the control pressure chamber and the inlet chamber, a first control valve including a first valve portion to adjust an opening degree of the supply passage, a second control valve provided on the bleed passage and including a spool housing recess formed on the bleed passage, and a back pressure chamber between the spool and a bottom of the spool housing recess.

5 Claims, 8 Drawing Sheets

(56) References Cited

U.S. PATENT DOCUMENTS

| | | | | |
|---|---|---|---|---|
| 5,785,502 | A * | 7/1998 | Ota | F04B 27/1036 417/222.1 |
| 6,263,687 | B1 * | 7/2001 | Ban | B60H 1/00914 417/222.2 |
| 2002/0006337 | A1 * | 1/2002 | Kimura | F04B 27/1804 417/222.2 |
| 2004/0258536 | A1 * | 12/2004 | Ota | F04B 27/1804 417/222.2 |
| 2005/0008499 | A1 * | 1/2005 | Umemura | F04B 27/1804 417/222.2 |
| 2009/0269216 | A1 * | 10/2009 | Ota | F04B 27/1804 417/222.1 |
| 2010/0104454 | A1 * | 4/2010 | Ota | F04B 27/1804 417/222.1 |
| 2011/0214564 | A1 * | 9/2011 | Okuda | F04B 27/1081 91/505 |
| 2012/0247140 | A1 * | 10/2012 | Yoshida | F04B 11/0091 62/228.3 |

FOREIGN PATENT DOCUMENTS

| | | | |
|---|---|---|---|
| JP | 2000-170654 | A | 6/2000 |
| JP | 2002-21721 | A | 1/2002 |

OTHER PUBLICATIONS

Written Opinion of the International Searching Authority issued in corresponding application No. PCT/JP2016/069082 dated Sep. 20, 2016 (4 pages).

* cited by examiner

VARIABLE CAPACITY COMPRESSOR

TECHNICAL FIELD

The present invention relates to a variable capacity compressor configured to vary a discharge capacity by adjusting a pressure in a control pressure chamber and, more specifically, to a variable capacity compressor including a supply passage causing a discharge chamber and a control pressure chamber to communicate with each other and a bleed passage causing the control pressure chamber and an inlet chamber to communicate with each other, and configured to adjust a pressure in the control pressure chamber by a control valve provided on the supply passage and a control valve provided on the bleed passage.

BACKGROUND ART

Variable capacity compressors employ a mechanism for adjusting a stroke amount of a piston by changing an angle of inclination of a swash plate by adjusting a pressure in a control pressure chamber, thereby varying a discharge capacity. Known examples of such a compressor include a compressor in which the discharge chamber and the control pressure chamber communicate with each other via the supply passage and the control pressure chamber and the inlet chamber communicate with each other via the bleed passage, and the pressure in the control pressure chamber is controlled by adjusting an amount of refrigerant flowing into the control pressure chamber by adjusting an opening degree of the supply passage by a control valve provided on the supply passage.

In this configuration, when the supply passage is closed by the control valve, introduction of a high-pressure gas from the discharge chamber into the control pressure chamber is eliminated, and the pressure in the control pressure chamber is lowered to substantially the same value as the pressure in the inlet chamber as the control pressure chamber and the inlet chamber constantly communicate with each other via the bleed passage, and thus the compressor is operated at the maximum capacity. When the supply passage is opened by the control valve, the high-pressure gas is introduced from the discharge chamber to the control pressure chamber, and a refrigerant gas flows out from the control pressure chamber to the inlet chamber via the bleed passage. However, as the pressure in the control pressure chamber increases, the discharge capacity of the compressor is controlled by adjustment of the opening degree of the supply passage by the control valve.

If the compressor is in a long-term stop without being operated, the pressure in a refrigerating cycle is counterbalanced, and the refrigerant in the refrigerating cycle is liquefied at a portion having the lowest temperature in the refrigerating cycle. As the compressor has the largest thermal capacity among elements that constitute the refrigerating cycle and can hardly be warmed up by following the changes in external temperature, liquefaction of refrigerant in the refrigerating cycle occurs in the compressor. When the refrigerant is liquefied in the compressor, the liquid refrigerant is accumulated in the control pressure chamber.

In the case where the compressor is activated from a state in which the pressure is counterbalanced, the pressure in the inlet chamber is lowered by the operation of the compressor and accordingly, the refrigerant in the control pressure chamber is discharged into the inlet chamber via the bleed passage. However, when the liquid refrigerant is accumulated in the control pressure chamber, the interior of the control pressure chamber is brought into a saturated state in which a gas-phase refrigerant and a liquid-phase refrigerant coexist, and thus the pressure in the control pressure chamber is maintained at a saturation pressure even when the refrigerant in the control pressure chamber is discharged into the inlet chamber via the bleed passage. Therefore, a problem is known in that the pressure in the control pressure chamber is not lowered until the entire liquid refrigerant is vaporized and discharged from the bleed passage, and thus discharge capacity control cannot be performed (the discharge capacity does not increase).

In order to solve the above described problem, a configuration as illustrated in FIG. 8 is known (see PTL1). This configuration includes a first control valve 104 configured to adjust the opening of the supply passage on a supply passage 103 configured to connect a discharge chamber 101 and a control pressure chamber 102, and a second control valve 107 provided on a bleed passage 106 configured to connect the control pressure chamber 102 and an inlet chamber 105, and the second control valve 107 is configured to include a spool housing recess 108 formed on a housing, a spool 109 movably housed in the spool housing recess 108, a back pressure chamber 110 segumentalized in the spool housing recess 108 behind the spool 109, and a biasing spring 112 configured to bias the spool 109 in a direction away from a valve forming body 111, and an intermediate area K between the first control valve 104 of the supply passage 103 and a fixed throttle 113 provided on a downstream side thereof is connected to the back pressure chamber 110 via the branch passage 114.

In this configuration, the first control valve 104 fully closes the supply passage 28, and blocks the communication between the discharge chamber 101 and the control pressure chamber 102 at the time of start-up in which a difference between a pressure Pd of the discharge chamber 101 and a pressure Ps of the inlet chamber 105 is small. Then, a pressure Pk in the intermediate area K in the supply passage 103 on the downstream side of the first control valve 104, that is, the pressure in the back pressure chamber 110 is maintained in substantially the same state as a pressure Pc of the control pressure chamber 102, and thus the spool 109 fully opens the bleed passage 106 by a spring force of the biasing spring 112.

Consequently, even when the liquid refrigerant is accumulated in the control pressure chamber 102, releasing and lowering of the pressure in the control pressure chamber 102 into the inlet chamber 105 via the bleed passage having a large opening degree in the early stage are enabled (time required for the entire liquid refrigerant accumulated in the control pressure chamber 102 to be vaporized and discharged into the inlet chamber 105 is reduced), and hence a problem of increase in time until the discharge capacity control is enabled may be avoided. Therefore, the pressure Pc in the control pressure chamber 102 is lowered by the first control valve 104 fully closed in a rapid manner, and an angle of inclination of the swash plate may increase in a rapid manner to increase the discharge capacity.

Subsequently, when the difference between the pressure Pd in the discharge chamber 101 and the pressure Ps in the inlet chamber 105 gradually increases after the entire liquid refrigerant accumulated in the control pressure chamber 102 is vaporized and discharged to the inlet chamber 105, a fully-closed state of the first control valve 104 is released and the supply passage 103 opens, and the pressure in the intermediate area K (the pressure in the back pressure chamber 110) exceeds the pressure Pc in the control pressure chamber 102. The spool 109 then comes into contact with the valve forming body 111 moving against the biasing spring 112, and the bleed passage 106 is significantly throttled by a communication groove 109*a* formed at a distal end of the spool 109. Therefore, the amount of the refrigerant introduced from the control pressure chamber 102 to the inlet chamber 105 via the bleed passage 106 significantly decreases, and thus the pressure Pc of the control pressure chamber 102 increases, so that the angle of inclination of the swash plate decreases to decrease the discharge capacity.

CITATION LIST

Patent Literature

PTL 1: JP-A-2002-021721
PTL 2: JP-A-2000-170654

SUMMARY OF INVENTION

Technical Problem

A vehicle air-conditioning apparatus may encounter the necessity to rapidly lower a power of a compressor temporarily (so-called, cut-off control) corresponding to circumstances such as sudden acceleration of the vehicle. It is known in a case of a refrigerating cycle using a variable capacity compressor that a high pressure in the discharge chamber is introduced into the control pressure chamber by opening the supply passage by the control valve provided on the supply passage connecting the discharge chamber and the control pressure chamber to decrease a discharge capacity of the compressor to the minimum upon such a request (See PTL2 for example). When such sudden acceleration control is performed on the compressor described in PTL1 described above, the discharge capacity of the compressor may be minimized by introducing the high pressure refrigerant in the discharge chamber into the control pressure chamber 102 by opening the communication between the discharge chamber 101 and the control pressure chamber 102 by the first control valve 104. At this time, the pressure Pk in the intermediate area in the supply passage 103 on the downstream side of the first control valve 104 is higher than the pressure in the control pressure chamber. The pressure Pk in the intermediate area is introduced also into the back pressure chamber 110 of the spool housing recess 108 and makes the spool 109 move in a direction to close the bleed passage 106 against a spring force of the biasing spring 112 to facilitate maintenance of the pressure in the control pressure chamber at a higher value.

For transferring from the minimum discharge capacity achieved by the cut-off control described above again to the maximum discharge capacity, the supply passage is closed by supplying electric power to the first control valve to block a supply of the high-pressure from the discharge chamber 101, while the pressure in the back pressure chamber 110 provided on the spool housing recess 108 behind the spool 109 for the second control valve 107 may be lowered only by opening the control pressure chamber 102 via the fixed throttle 113 provided on the downstream of the first control valve, and in addition, the pressure in the control pressure chamber 102 is a high value corresponding to the sudden acceleration control. Consequently, a problem arises in that lowering of the pressure in the back pressure chamber 110 takes time and thus opening of the second control valve may delay (the spool 109 cannot move easily in an opening direction). Therefore, a problem arises in that the releasing of the pressure from the control pressure chamber to the inlet chamber may delay, and thus translation to the maximum capacity control may delay.

In order to solve this issue, an increase in spring force of the biasing spring 112 is contemplated. However, as the increase in spring force of the biasing spring 112 may impair easy closing of the second control valve when an attempt is made to operate the compressor in an intermediate stroke state and increases an amount of leakage from the control pressure chamber to the inlet chamber, thereby deteriorating COP.

In view of such circumstances, it is a main object of the present invention to provide a variable capacity compressor configured to achieve an enhancement of a start-up performance of a compressor and reduce an amount of internally circulating refrigerant during an intermediate stroke in a simple structure.

Solution to Problem

In order to solve the above-described problem, a variable capacity compressor according to the present invention includes a compression chamber configured to compress a working fluid, an inlet chamber configured to house the working fluid to be compressed in the compression chamber; a discharge chamber configured to house the working fluid compressed in the compression chamber and discharged therefrom; a control pressure chamber including a drive shaft penetrating therethrough and housing a swash plate rotating in accordance with a rotation of the drive shaft; a supply passage configured to cause the discharge chamber and the control pressure chamber communicate with each other; a bleed passage configured to cause the control pressure chamber and the inlet chamber to communicate with each other; a first control valve including a first valve portion configured to be able to adjust an opening degree of the supply passage; and a second control valve provided on the bleed passage, wherein the second control valve includes a spool housing recess formed on the bleed passage; a spool housed in the spool housing recess and configured to be movable to open and close the bleed passage; a back pressure chamber segmentalized in the spool housing recess behind the spool; and biasing means configured to bias the spool in an opening direction of the bleed passage, wherein the supply passage being connected to the back pressure chamber on the downstream side of the first valve portion of the first control valve to open and close the bleed passage based on a pressure in the back pressure chamber, wherein the first control valve further includes: a low-pressure side passage branched from the supply passage at a point downstream of the first valve portion and communicating with the inlet chamber, and a second valve portion configured to be able to adjust an amount of opening of the low-pressure side passage, the first valve portion and the second valve portion are in an interlocked relationship such that when one closes a corresponding passage, the other opens the corresponding passage (in a relationship bringing the low-pressure side passage into an opened state by the second valve portion when the bleed passage is brought into a closed state by the first valve portion, and bringing the bleed passage into the opened state by the first valve portion when the low-pressure side passage is brought into the closed state by the second valve portion), and the back pressure chamber is selectively connected to the discharge chamber or the inlet chamber via the first valve portion or the second valve portion of the first control valve.

In this configuration, when activating the compressor from a state in which the compressor has been in a long-term stop and thus the pressure in the refrigerating cycle is counterbalanced (at the time of a cold start), the pressure in the back pressure chamber may be lowered to substantially the same pressure as the pressure in the inlet chamber by connecting the back pressure chamber to the inlet chamber via the second valve portion of the first control valve. Accordingly, the second control configured to open the bleed passage based on the pressure in the back pressure chamber reliably opens the bleed passage, and the vaporized refrigerant in the control pressure chamber is discharged to the inlet chamber via the bleed passage.

Accordingly, release of the refrigerant in the control pressure chamber in a rapid manner to the inlet chamber is enabled, and time required for the entire liquid refrigerant accumulated in the control pressure chamber to be vaporized and discharged into the inlet chamber may be reduced.

After the entire liquid refrigerant in the control pressure chamber is discharged and the piston stroke (discharge capacity) increases, when the refrigerating cycle is forced to be stopped by rapid decreasing of the discharge capacity of the compressor according to circumstances such as sudden acceleration of the vehicle or the like, the supply passage is opened by the first valve portion of the first control valve to introduce a high-pressure gas in the discharge chamber into the control pressure chamber and decreases the piston stroke promptly, and the high-pressure gas in the discharge chamber is introduced into the back pressure chamber of the second control valve, so that the bleed passage is closed by the second control valve. Accordingly, the flowing out of refrigerant introduced into the control pressure chamber to the inlet chamber may be decreased, and the discharge capacity of the compressor may be decreased only with an introduction of the minimum refrigerant gas. In other words, by connecting the back pressure chamber to the discharge chamber via the first valve portion of the first control valve, the bleed passage is closed, and thus the amount of the refrigerant flowing out from the control pressure chamber into the inlet chamber may be decreased.

Subsequently, for increasing the discharge capacity of the compressor again, as the high-pressure gas retained in the back pressure chamber may be discharged into the inlet chamber via the first control valve by connecting the back pressure chamber to the inlet chamber by the second valve portion of the first control valve, the spool housed in the spool housing recess is moved into an opening direction by biasing means, and the bleed passage is opened.

Accordingly, the pressure in the control pressure chamber may be released to the inlet chamber via the bleed passage in a rapid manner, and the discharge capacity at the time of restarting may be increased in a rapid manner.

In this manner, as opening-closing control of the bleed passage may be achieved by selectively connecting the back pressure chamber of the spool housing recess to the discharge chamber or the inlet chamber by the first control valve, start-up performance of the compressor may be enhanced, and the internally circulating refrigerant at the time of reducing the discharge capacity may be reduced.

In the above-described configuration, the fixed throttle may be provided on the supply passage at a position downstream of a position to which the back pressure chamber is connected.

With this fixed throttle, when the supply passage is put in the opened state by the first control valve, the pressure on an upstream side of the fixed throttle (the pressure in the back pressure chamber) is increased so that the bleed passage may be reliably closed by the spool.

The bleed passage may be connected to a bypass passage which bypasses the second control valve and is connected to the inlet chamber, and the bypass passage may be provided with the fixed throttle.

This configuration ensures a circulation of the minimum amount of a refrigerant gas in the control pressure chamber owing to the fixed throttle in the bypass passage even though the supply passage is opened by the first control valve and the bleed passage is closed. When the back pressure chamber and the inlet chamber communicate with each other via the first control valve, the refrigerant in the control pressure chamber may be released to the inlet chamber via the fixed throttle of the bypass passage in addition to the bleed via the second control valve, so that the pressure in the control pressure chamber may be lowered in a rapid manner.

Advantageous Effects of Invention

As described thus far, according to the present invention, in the variable capacity compressor configured to adjust a pressure of a control pressure chamber by adjusting the opening degree of the supply passage configured to cause the discharge chamber and the control pressure chamber to communicate with each other by the first control valve, and adjusting the opening degree of the bleed passage causing the control pressure chamber and the inlet chamber to communicate with each other by the second control valve, wherein the second control valve includes: a spool housing recess formed on the bleed passage, a spool housed in the spool housing recess and configured to be movable to open and close the bleed passage; a back pressure chamber segmentalized in the spool housing recess behind the spool; and biasing means configured to bias the spool in an opening direction of the bleed passage, the supply passage being connected on a downstream side with respect to the first control valve to the back pressure chamber, and wherein the back pressure chamber of the spool housing recess is configured to be connected selectively to the discharge chamber or the inlet chamber by the first control valve, so that the pressure in the back pressure chamber may be discharged to the inlet chamber in a rapid manner by connecting the back pressure chamber to the inlet chamber via the first control valve at the time of start-up, so that the start-up performance of the compressor may be improved.

In addition, when the stroke is reduced in which the supply passage is opened by the first valve portion of the first control valve, the bleed passage may be closed by connecting the back pressure chamber to the discharge chamber via the first control valve, so that the flow of the refrigerant from the control pressure chamber to the inlet chamber may be blocked to decrease the amount of refrigerant circulating the interior with the decreased stroke.

In the configuration described above, by further providing a fixed throttle on the supply passage at a position on a downstream side of a position to which the back pressure chamber is connected, the pressure on the upstream side of the fixed throttle (pressure in the back pressure chamber) may be reliably increased in a state in which the first control valve opens the supply passage, so that the bleed passage may be reliably closed by the spool.

In addition, by further adding a configuration on the bleed passage in which a bypass passage which bypasses the second control valve is connected to the inlet chamber is connected, and a fixed throttle is provided on the bypass passage, even when the first control valve opens the supply passage and closes the bleed passage, the circulation of the minimum amount of the refrigerant gas in the control pressure chamber is ensured by the fixed throttle in the bypass passage. When the first control valve causes the downstream side of the supply passage with respect to the first control valve to communicate with the inlet chamber, the refrigerant in the control pressure chamber may be released to the inlet chamber not only via the bleed via the second control valve, but also via the fixed throttle in the bypass passage. Therefore, the pressure in the control pressure chamber may be decreased in a rapid manner.

DESCRIPTION OF EMBODIMENT

Referring now to the attached drawings, embodiments of the present invention will be described.

Figure 1:
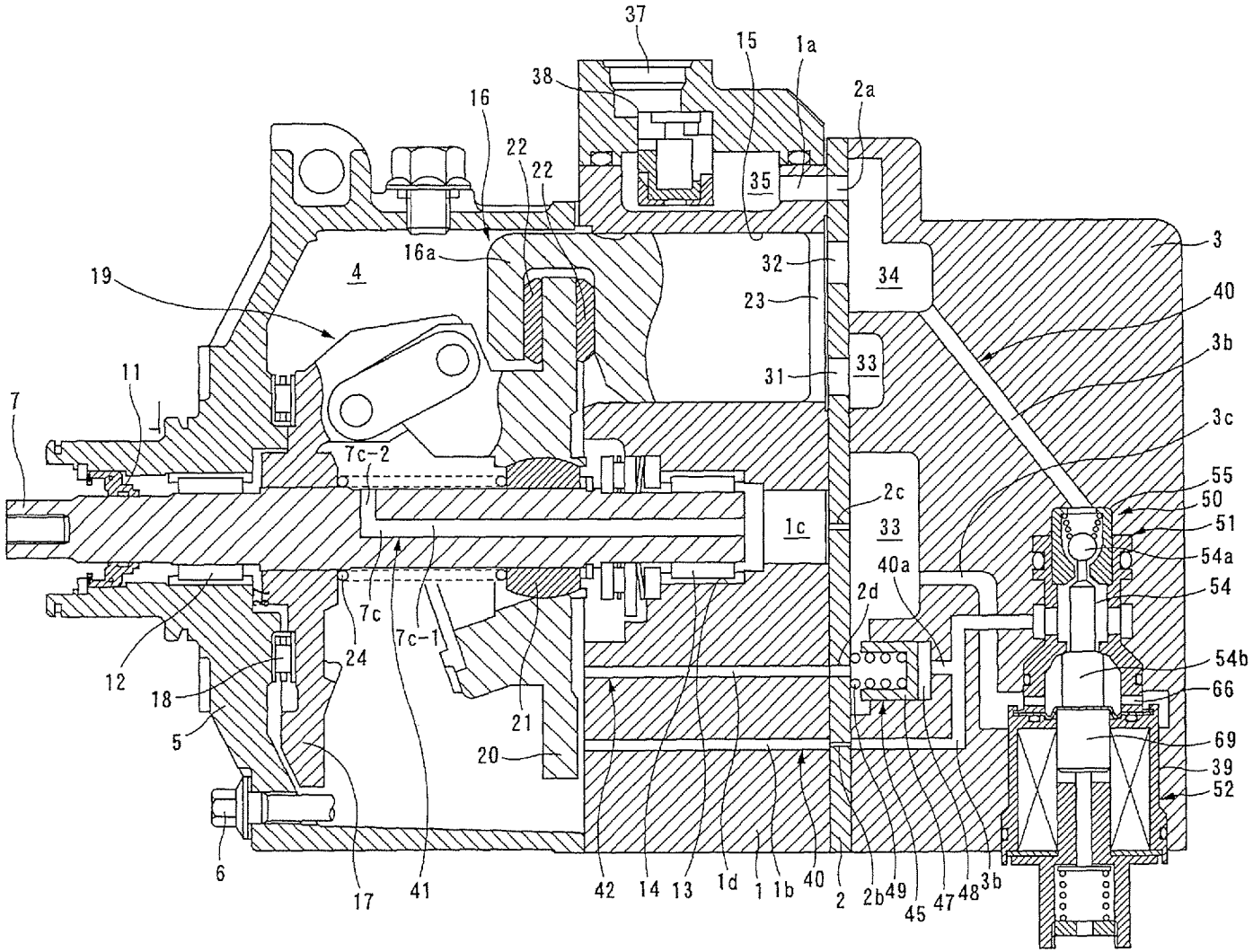
FIG. 1 is a cross-sectional view of a compressor according to the present invention illustrating a state in which the compressor is stopped and thus a pressure in an interior of the compressor is counterbalanced and a state of initial state of activation of the compressor.
Figure 2:
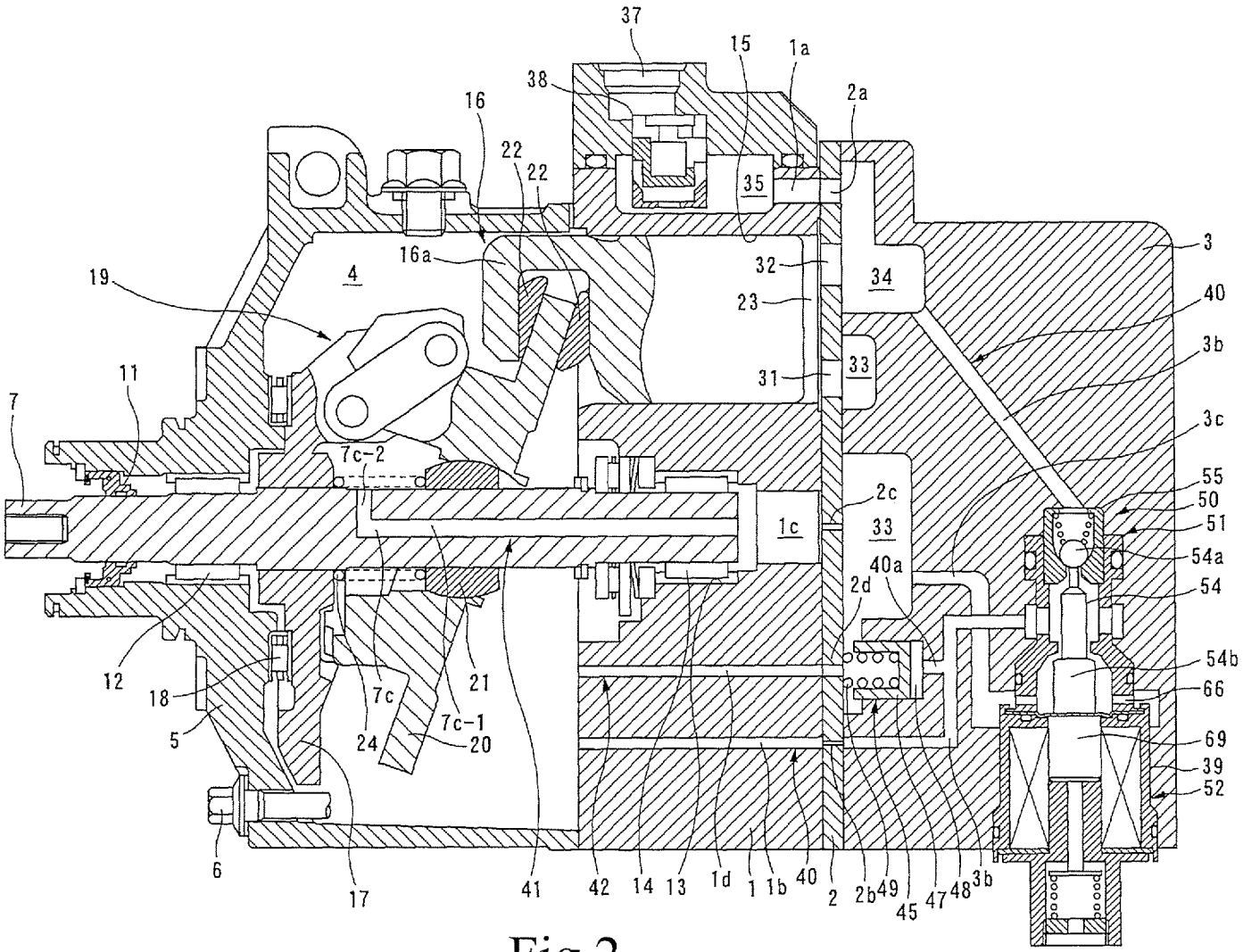
FIG. 2 is a cross-sectional view illustrating a compressor according to the present invention, illustrating a full-stroke state.
Figure 3:
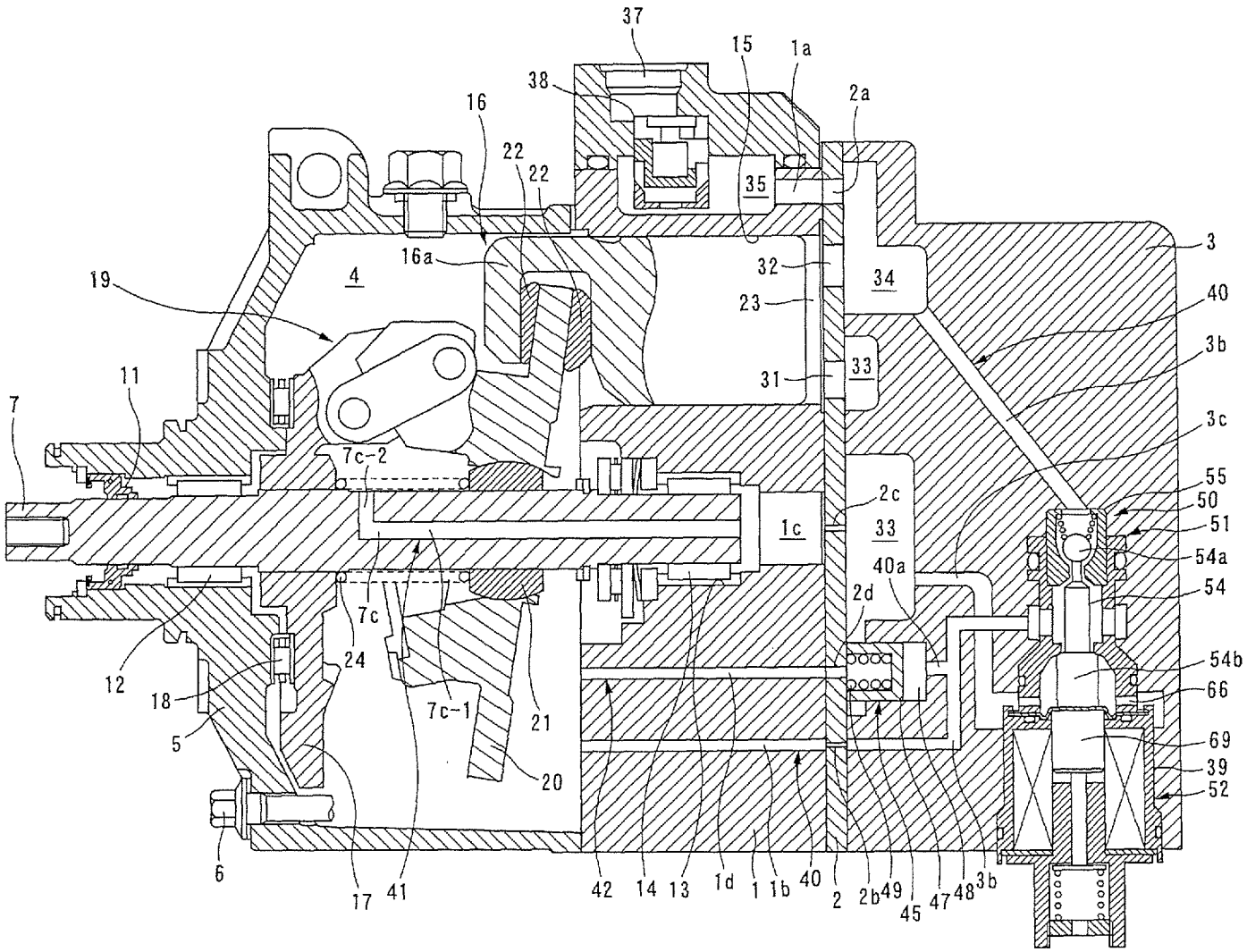
FIG. 3 is a cross-sectional view illustrating a compressor according to the present invention, illustrating a reduced-stroke state.

FIG. 1 to FIG. 3 illustrate a variable capacity compressor according to the present invention. The variable capacity compressor includes a cylinder block 1, a rear head 3 assembled to a rear side (right side in the drawing) of the cylinder block 1 via a valve plate 2, and a front head 5 assembled to block up a front side (left side in the drawing) of the cylinder block 1 and defining a control pressure chamber 4. The front head 5, the cylinder block 1, the valve plate 2, and the rear head 3 are fastened in an axial direction by a tightening bolt 6 to constitute a housing of the compressor.

The control pressure chamber 4 defined by the front head 5 and the cylinder block 1 houses a drive shaft 7 projecting at a front end thereof from the front head 5. A portion of the drive shaft 7 projecting from the front head 5 is provided with a drive pulley, not illustrated, to transmit a rotary power given to the drive pulley to the drive shaft 7 via an electromagnetic clutch.

The front end side of the drive shaft 7 is provided with a hermetical sealing with respect to the front head 5 via a seal member 11 provided between the drive shaft 7 and the front head 5 and is rotatably supported by a radial bearing 12, and a rear end side of the drive shaft 7 is rotatably supported via a radial bearing 14 housed in a holding hole 13 formed at a substantially center of the cylinder block 1. Here, the radial bearings 13, 14 may be rolling bearings or plane bearings.

The cylinder block 1 includes the holding hole 13 in which the radial bearing 14 is housed and a plurality of cylinder bores 15 arranged equidistantly on a circumference about the holding hole 13, and the respective cylinder bores 15 include one head pistons 16 inserted therein in a slidable reciprocal manner.

A thrust flange 17 is fixed to the drive shaft 7 in the control pressure chamber 4 and integrally rotates with the drive shaft 7. The thrust flange 17 is supported by, and rotatably with respect to, an inner surface of the front head 5 via a thrust bearing 18, and a swash plate 20 is coupled to the thrust flange 17 via a link member 19.

The swash plate 20 is tiltable about a hinge ball 21 slidably provided on the drive shaft 7, and is configured to integrally rotate synchronously with a rotation of the thrust flange 17 via the link member. An engagement member **16*a* of the one-head pistons 16 engages a peripheral edge portion of the swash plate 20 via a pair of shoes 22**.

Therefore, when the drive shaft 7 rotates, the swash plate 20 rotates correspondingly, and a rotary motion of the swash plate 20 is transformed into a reciprocal linear motion of a one-head pistons 16 via the shoes 22 to vary a capacity of a compression chamber 23 formed in the cylinder bores 15 between the one-head pistons 16 and the valve plate 2.

The valve plate 2 includes an inlet port 31 and a discharge hole 32 corresponding to each of the cylinder bores 15, and the rear head 3 is provided with an inlet chamber 33 configured to house a working fluid to be compressed in the compression chamber 23, and a discharge chamber 34 configured to house a working fluid compressed and discharged from the compression chamber 23. In this example, the inlet chamber 33 is formed in the rear head 3 at a portion near the center, and is configured to communicate with an inlet port, not illustrated, leading to an exit side of an evaporator, and can be communicate with the compression chamber 23 via the inlet port 31 which is opened and closed by an inlet valve, not illustrated. The discharge chamber 34 is formed around the inlet chamber 33, and can communicate with the compression chamber 23 via the discharge hole 32 which is opened and closed by a discharge valve, not illustrated, and is configured to communicate with a discharge space 35 formed in an peripheral wall portion of the cylinder block 1 via passages **2*a*, 1*a* formed in the valve plate 2 and the cylinder block 1. The discharge space 35 is defined by the cylinder block 1 and a cover 36 mounted thereon, and the cover 36 includes a discharge port 37 leading to an entrance side of a condenser and a check valve 38 configured to prevent the refrigerant from flowing inversely from the condenser to the discharge space 35** formed therein.

The discharge capacity of the compressor is determined by a stroke of the pistons 16, and the stroke is determined by the angle of inclination of the swash plate 20 with respect to a face vertical to the drive shaft 7. The angle of inclination of the swash plate 20 is balanced at an angle which makes a sum of a moment caused by a difference between a pressure in the compression chamber 23 (the pressure in the cylinder bore) acting on the respective pistons 16 and the pressure in the control pressure chamber 4, a moment caused by an inertia force of the swash plate or the piston, and a moment caused by a biasing force of a destroke spring 24 biasing a hinge ball 21. Accordingly, the piston stroke is determined to determine the discharge capacity.

In other words, if the pressure in the control pressure chamber 4 decreases, the difference in pressure between the compression chamber 23 and the control pressure chamber 4 increases, and thus a moment acts on a direction to increase an angle of inclination of the swash plate 20. Therefore, as illustrated in FIG. 2, if the angle of inclination of the swash plate 20 increases, the hinge ball 21 moves toward the thrust flange 17 against a biasing force applied from the destroke spring 24 to increase the amount of stroke of the pistons 16 and thus increase the discharge capacity.

In contrast, if the pressure in the control pressure chamber 4 increases, the difference in pressure between the compression chamber 23 and the control pressure chamber 4 decreases, and thus a moment acts on a direction to decrease an angle of inclination of the swash plate 20. Therefore, as illustrated in FIG. 3, if the angle of inclination of the swash plate 20 decreases, the hinge ball 21 moves away from the thrust flange 17 to decrease the amount of stroke of the pistons 16 and thus decrease the discharge capacity.

In this configuration example, a passage 1*b* formed in the cylinder block 1, a fixed throttle (orifice hole) 2*b* formed in the valve plate 2, and a passage 3*b* formed in the rear head 3 constitute a supply passage 40 that causes the discharge chamber 34 and the control pressure chamber 4 to communicate with each other.

A second bleed passage 41 configured to cause the control pressure chamber 4 and the inlet chamber 33 via a gap of the radial bearing 14 housed in the holding hole 13 formed in the cylinder block 1, an oil separation channel 7*c* formed in the drive shaft 7, a communication hole 1*c* of the cylinder block 1 formed to continue from the holding hole 13, and an orifice hole 2*c* which is formed in the valve plate 2 and which communicates with the communication hole 1*c* to communicate with each other, and a first bleed passage 42 causing the control pressure chamber and the inlet chamber to communicate with each other via passages 1*d*, 2*d* formed in the cylinder block 1 and the valve plate 2 are formed.

Here, the oil separation passage 7*c* formed in the drive shaft 7 constituting part of the second bleed passage 41 includes an axial through hole 7*c*-1 formed from a rear end toward a front end to a position in the vicinity of the distal end on an axial center of the drive shaft 7 and a radial through hole 7*c*-2 communicating with the axial through hole 7*c*-1 and formed in the radial direction of the drive shaft 7 and opening to the control pressure chamber 4, and has a function to separate oil from a working fluid flowing from the radial through hole 7*c*-2 by a centrifugal force generated by the rotation of the drive shaft 7.

The supply passage 40 includes a first control valve 50 provided thereon to adjust an amount of the refrigerant gas flowing from the discharge chamber 34 through the supply passage 40 into the control pressure chamber 4 by the first control valve 50. The first bleed passage 42 includes a second control valve 45 provided thereon to adjust the amount of the refrigerant gas flowing from the control pressure chamber 4 through the first bleed passage 42 into the inlet chamber 33 by the second control valve 45.

Figure 4:
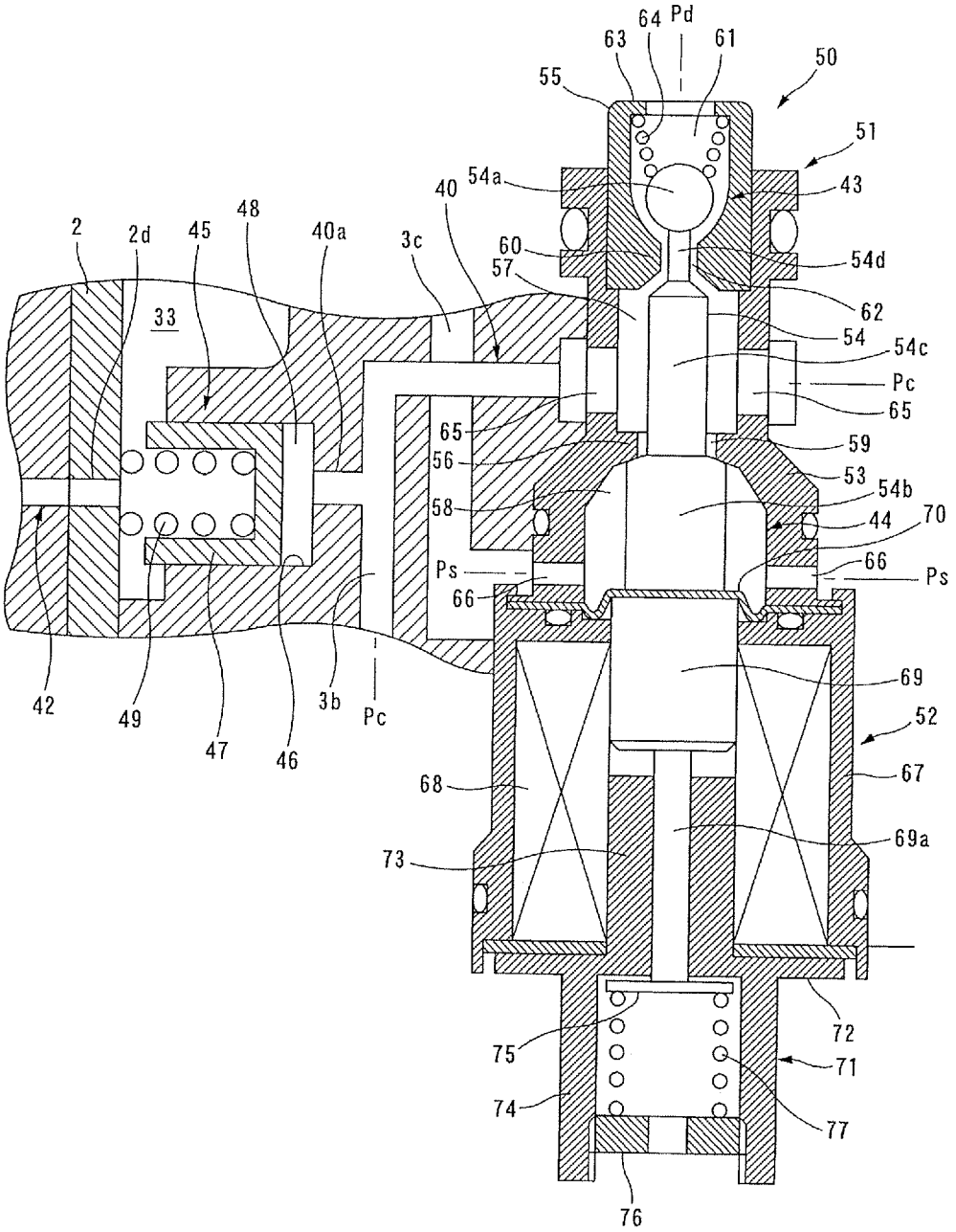
FIG. 4 is a drawing illustrating a first control valve and a second control valve in detail.

The second control valve 45 will be described now. The second control valve 45 includes a spool housing recess 46 formed at a location facing a through hole 2*d* formed in the valve plate 2 of the inner wall of the inlet chamber formed on the rear head 3 as illustrated in FIG. 4, and includes a bottomed cylindrical spool 47 movably (in the direction toward and away from the valve plate 2) housed in the spool housing recess 46 to open and close the first bleed passage 42, a back pressure chamber 48 segmentalized in the spool housing recess 46 behind the spool 47 and biasing means (compression spring 49) configured to bias the spool 47 in the opening direction (direction away from the valve plate 2) of the first bleed passage 42.

Therefore, the position of the spool 47 is determined by a balance of a force applied to the spool 47, and if a force based on a pressure in the back pressure chamber 48 is larger than a sum of a force based on a pressure in the control pressure chamber 4 acting via the first bleed passage 42 and a biasing force applied by the biasing means (compression spring 49), the spool 47 moves leftward in the drawing against the biasing force of the biasing means (compression spring 49) to close the first bleed passage 42. If a force based on the pressure in the back pressure chamber 48 is smaller than a sum of a force based on the pressure in the control pressure chamber 4 acting via the first bleed passage 42 and the biasing force applied by the biasing means (compression spring 49), the spool 47 moves rightward in the drawing by the biasing means to open the first bleed passage 42.

The back pressure chamber 48 of the second control valve 45 is connected to the downstream side of the supply passage 40 with respect to the first control valve 50 vis a branch passage 40*a*, and thus an introduction pressure of the back pressure chamber 48 of the second control valve 45 may be adjusted by the first control valve 50.

The first control valve 50 is inserted into a mounting hole 39 formed in the rear head 3, controls the pressure in the control pressure chamber 4 by adjusting the opening degree of the supply passage 40 to achieve an inlet pressure of a target value, and performs actions including fully-opening the supply passage 40 by discontinuing a power supply, minimizing the discharge capacity by increasing the pressure in the control pressure chamber 4, fully-closing the supply passage 40 by maximizing the amount of power supply (duty ratio: 100%) at the initial stage after start-up, and discontinuing the pressure supply to the control pressure chamber 4.

The first control valve 50 includes a flow passage switching unit 51 and a drive unit 52 as illustrated in FIG. 4.

The flow passage switching unit 51 includes a cylindrical head case 53, an operation rod 54 housed in the head case 53 so as to be capable of advancing and retracting along a center line, and a valve retainer 55 assembled to a distal end portion of the head case 53.

The operation rod 54 includes a spherical first valve portion 54*a* provided at a distal end portion, a cylindrical second valve portion 54*b* provided at a proximal end portion and having an enlarged diameter, and a relay rod 54*c* coupling the first valve portion 54*a* and the second valve portion 54*b*, and a portion to continue to the first valve portion of the relay rod includes a small-diameter portion 54*d* having a reduced diameter.

The relay rod 54*c* is formed to have a diameter smaller than the second valve portion 54*b*, and passes through a valve retaining portion 56 projecting inward from an inner peripheral surface at an approximately midsection of the head case 53. The valve retaining portion 56 has an inner peripheral surface larger in diameter than that of a proximal portion of the relay rod 54*c* and smaller than that of the second valve portion 54*b*. The head case 53 includes a pressure adjusting chamber 57 in the interior thereof around the relay rod 54*c* and a low pressure chamber 58 around the second valve portion 54*b* on both sides with respect to the valve retaining portion 56, and a low-pressure side communication hole 59 causing the pressure adjusting chamber 57 and the low pressure chamber 58 to communicate with each other is formed between the inner peripheral surface of the valve retaining portion 56 and the relay rod 54*c*.

The valve retainer 55 to be assembled to the distal end portion of the head case 53 is formed into a cylindrical shape opening widely at a distal end thereof, is provided at a proximal end thereof with a valve retaining portion 60 projecting inward from an inner peripheral surface thereof, and includes a valve storage space 61 at a distal end side of the valve retaining portion 60. The small-diameter portion 54*d* of the operation rod 54 is inserted through the valve retaining portion 60 and the first valve portion 54*a* of the operation rod 54 is housed in the valve storage space 61. The valve retaining portion 60 is formed to have an inner peripheral surface larger than the diameter of the small-diameter portion 54*d* of the operation rod 54 and smaller than the diameter of the first valve portion 54*a*, and a high-pressure side communication hole 62 causing the valve storage space 61 and the pressure adjusting chamber 57 to communicate with each other is formed between the inner peripheral surface of the valve retaining portion 60 and the small-diameter portion 54*d*.

The valve storage space 61 of the valve retainer 55 includes a compression spring 64 resiliently provided between a spring retainer 63 formed at an opened end portion and the first valve portion 54*a*, and the first valve portion 54*a* is constantly biased by the compression spring 64 in a direction to close the high-pressure side communication hole 62.

Therefore, when the operation rod 54 moves upward in the drawing against a biasing force of the compression spring, the first valve portion 54*a* moves away from the valve retaining portion 60 to open the high-pressure side communication hole 62, and then the second valve portion 54*b* comes into contact with the valve retaining portion 56 to close the low-pressure side communication hole 59. In contrast, when the operation rod 54 moves downward in the drawing by the biasing force of the compression spring 64, the first valve portion 54*a* comes into contact with the valve retaining portion 60 to close the high-pressure side communication hole 62, and then the second valve portion 54*b* moves away from the valve retaining portion 56 to open the low-pressure side communication hole 59.

The pressure adjusting chamber 57 communicates with the control pressure chamber 4 via a control pressure chamber communication hole 65 opening on a side surface of the head case 53 and the supply passage 40, and the low pressure chamber 58 communicates with the inlet chamber 33 via a low pressure chamber communication hole 66 opening on the side surface of the head case 53 and a low pressure passage 3*c* formed in the rear head 3, and the valve storage space 61 of the valve retainer 55 communicates with the discharge chamber 34 via the passage 3*b* formed in the rear head 3.

Therefore, in the interior of the first control valve 50, the valve storage space 61, the high-pressure side communication hole 62, the pressure adjusting chamber 57, and the control pressure chamber communication hole 65 constitute a high-pressure side passage 43 which causes an upstream side and a downstream side of the first control valve 50 of the bleed passage 40 to communicate with each other, and the opening degree of the high-pressure side passage 43 (the opening degree of the supply passage 40) is adjusted by the first valve portion 54*a*. In addition, the low-pressure side communication hole 59, the low pressure chamber 58, and the low pressure chamber communication hole 66 constitute a low-pressure side passage 44 branched from the downstream of the supply passage 40 with respect to the first valve portion 54*a* and connected to the low pressure passage 3*c* connected in communication with the inlet chamber 33, and the opening degree of the low-pressure side passage 44 is adjusted by a second valve portion 54*c*.

The drive unit 52 includes an intermediate case 67 to be hermetically assembled to the head case 53 of the flow passage switching unit 51 via an O-ring for sealing, an exciting coil 68 to be housed in the intermediate case 67, an iron piece 69 as a magnetic body housed so as to be capable of advancing and retracting on the center axis of the exciting coil 68, and a bottom case 71 provided so as to close an end of the intermediate case 67 on an opposite side from the head case 53.

Provided between the head case 53 and the intermediate case 67 is a diaphragm 70 formed of a thin film fixedly held therebetween, and the diaphragm 70 separates the flow passage switching unit 51 and the drive unit 52 to receive the pressure in the low pressure chamber 58.

A proximal end of the operation rod 54 is hermetically secured to a center of an end surface of the diaphragm 70 facing the low pressure chamber 58. The iron piece 69 is coupled to the operation rod 54 via the diaphragm 70 on an end surface on a drive unit side of the diaphragm 70.

The bottom case 71 is formed of iron, and includes a flange portion 72 configured to close the end of the intermediate case 67 on the opposite side from the head case 53, an iron core portion 73 projecting from the flange portion 72, and a spring housing portion 74 extending from the flange portion 72 on the opposite side from the iron core portion 73. The iron core portion 73 is inserted and located in the exciting coil 68, and is fixed to the iron piece 69 at a predetermined distance from the iron piece 69.

A rod 69*a* integrally formed with the iron piece 69 passes through the iron core portion 73 and projects into the spring housing portion 74 in an axial direction, and includes a spring retainer 75 fixed to an end of the rod 69*a*, an adjustment nut 76 mounted to an opened end so as to be capable of advancing and retracting in the axial direction by being screwed therein, and a compression spring 77 resiliently housed between the spring retainer 75 and the adjustment nut 76 housed therein, and the iron piece 69 is biased in a direction away from the iron core portion 73 via the rod 69*a* with the compression spring 77. The biasing force of the compression spring 77 is configured to be adjusted as needed by adjusting an amount of advancement and retraction of the adjustment nut 76.

Therefore, in this configuration, as the iron piece 69 is attracted to the iron core portion 73 of the bottom case 71 by supplying electric power to the exciting coil 68, the operation rod 54 coupled thereto is attracted. Consequently, the first valve portion 54*a* closes the high-pressure side communication hole 62 and the second valve portion 54*b* opens the low-pressure side communication hole 59, the control pressure chamber communication hole 65 and the low pressure chamber communication hole 66 communicate with each other via the low-pressure side communication hole 59, and the control pressure chamber 4 and the inlet chamber 33 communicate with each other via the low-pressure side communication hole 59 of the first control valve 50. When no power is supplied to the exciting coil 68, an electromagnetic force for attracting the iron piece 69 is not generated, and thus the iron piece 69 is moved away from the iron core portion 73 of the bottom case 71 by the compression spring 77, and accordingly, the operation rod 54 is pushed upward against the compression spring 64 so that the first valve portion 54*a* opens the high-pressure side communication hole 62, and the second valve portion 54*b* closes the low-pressure side communication hole 59, the high-pressure side communication hole 62 causes the control pressure chamber communication hole 65 and the valve storage space 61 of the spring retainer 55 to communicate with each other, and the high-pressure side communication hole 62 of the first control valve 50 causes the control pressure chamber 4 and the discharge chamber 34 to communicate with each other.

In other words, the first valve portion and the second valve portion of the first control valve have an interlocked relationship such that one closes the corresponding passage, and the other opens the corresponding passage, and thus the first control valve 50 functions as a three-way valve which switches between a case where the back pressure chamber 48 of the second control valve 45 communicates with the discharge chamber 34 and a case where the same communicates with the inlet chamber 33.

Figure 5A:
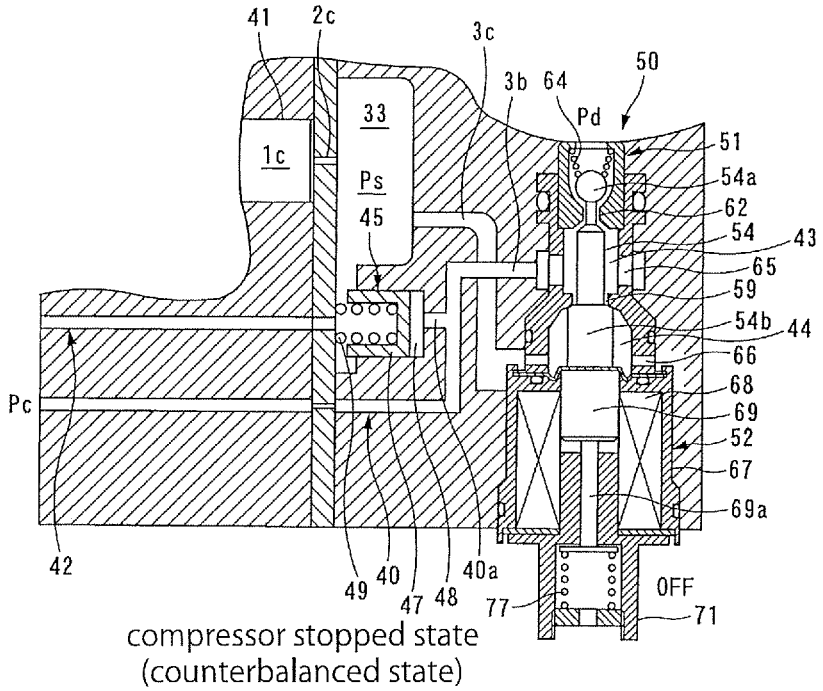
FIG. 5 is drawings illustrating a relationship between the second control valve (back pressure chamber) and the first control valve, in which (a) is an explanatory drawing illustrating an state in which the compressor is stopped and the pressure in the interior of the compressor is in the counterbalanced state, and (b) is an explanatory drawing illustrating an initial (Cold Start) state of start-up of the compressor which has been stopped.
Figure 5B:
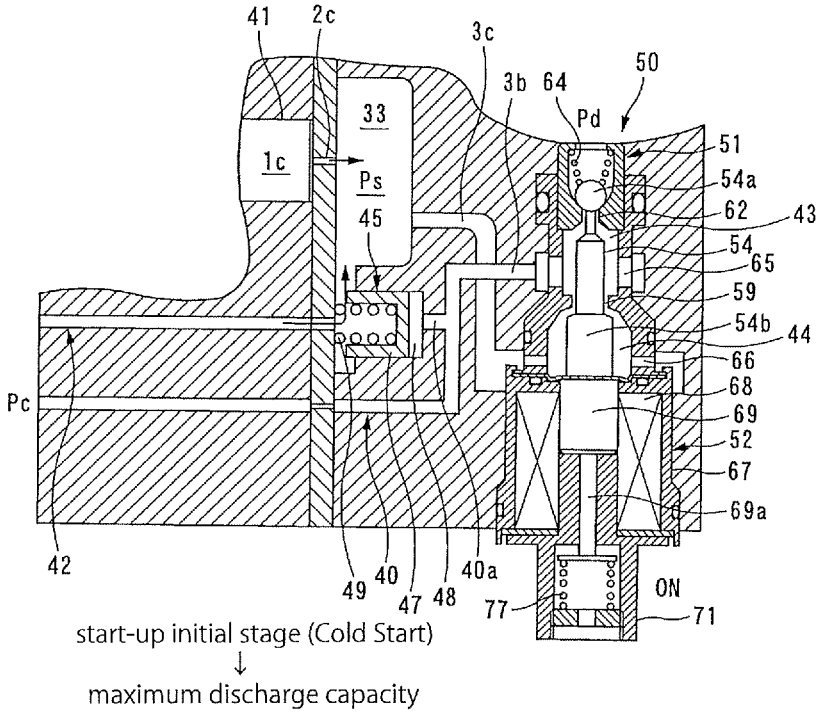

In this configuration, in a state in which the compressor has been in a long-term stop, the pressure Pd of the discharge chamber 34 and the pressure Pc of the control pressure chamber 4, and the pressure Ps of the inlet chamber 33 are substantially equivalent as illustrated in FIG. 5(*a*), and no electric power is supplied to the first control valve 50. Accordingly, the high-pressure side communication hole 62 (high-pressure side passage 43) is in the fully-opened state, and the low-pressure side communication hole 59 (low-pressure side passage 44) in the fully closed state, so that the back pressure chamber 48 of the second control valve 45 is connected to the discharge chamber 34 via the first control valve 50. Since pressures applied to the spool 47 housed in the spool housing recess on its front and rear are balanced, the spool valve is biased by the biasing means (compression spring 49) to bring the first bleed passage 42 in the open state.

When the compressor is operated from this state and an electric power is supplied to the first control valve 50, the high-pressure side communication hole 62 (high-pressure side passage 43) is closed by the first valve portion 54*a*, and the low-pressure side communication hole 59 (low-pressure side passage 44) is opened by the second valve portion 54*b* as illustrated in FIG. 5(*b*), so that the back pressure chamber 48 of the second control valve 45 is connected to the inlet chamber 33 via the low-pressure side communication hole 59 (flow-pressure side passage 44) of the first control valve 50.

Therefore, as the back pressure chamber 48 and the inlet chamber 33 communicate with each other via the first control valve 50, the pressure in the back pressure chamber 48 may be lowered to substantially the same pressure as the inlet chamber 33, whereby the opened state of the first bleed passage 42 is maintained. Therefore, the vaporized refrigerant generated in the control pressure chamber 4 is discharged to the inlet chamber 33 via the first and second bleed passages 42, 41.

Accordingly, the refrigerant in the control pressure chamber 4 may be released in a rapid manner to the inlet chamber 33, and time required for the entire liquid refrigerant accumulated in the control pressure chamber 4 to be vaporized and discharged into the inlet chamber 33 may be reduced.

When the entire liquid refrigerant in the control pressure chamber 4 is discharged and thus the pressure in the control pressure chamber 4 is lowered, the discharge capacity of the compressor increases and the pressure in the discharge chamber 34 increases. However, as a high-pressure gas is not supplied from the discharge chamber 34 into the control pressure chamber 4 and the back pressure chamber 48 via the supply passage 40 as long as the first valve portion 54*a* of the first control valve 50 does not open the high-pressure side communication hole 62, the first bleed passage 42 may be kept in the opened state, and a refrigerant gas in the control pressure chamber 4 is discharged into the inlet chamber 33 not only via the second bleed passage 41, but also via the first bleed passage 42, and the piston stroke (the discharge amount) is increased to the maximum.

Figure 6A:
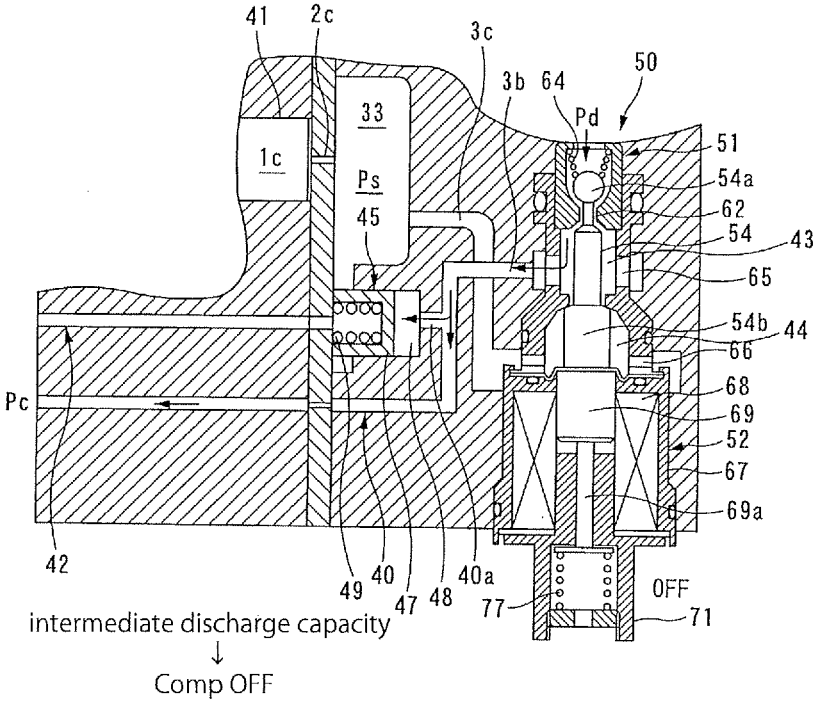
FIG. 6 is drawings illustrating a relationship between the second control valve (back pressure chamber) and the first control valve, in which (a) is an explanatory drawing illustrating a forced transfer from an intermediate discharge capacity to a small discharge capacity under the discharge capacity control of the compressor and (b) is an explanatory drawing illustrating a state of the compressor transferred to the minimum discharge capacity is restarted.
Figure 6B:
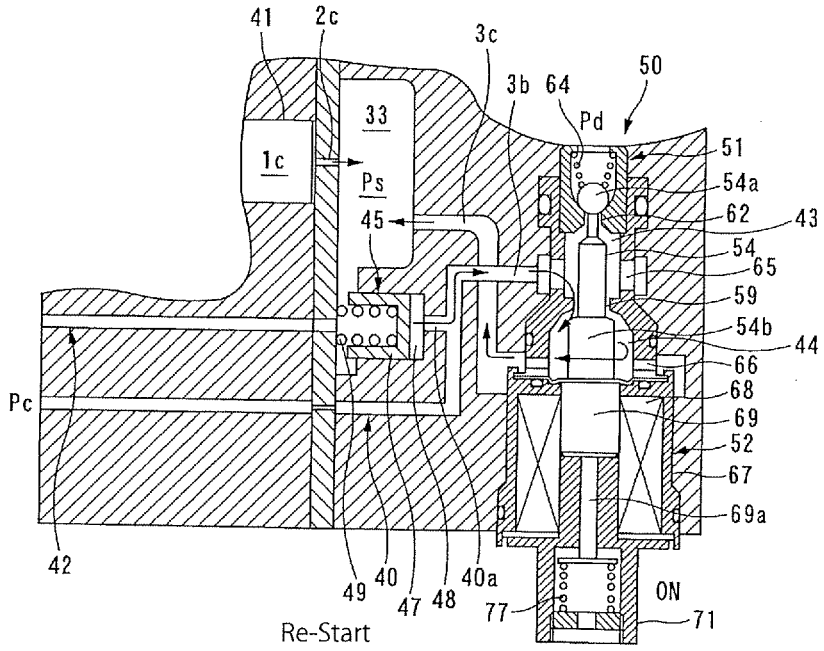

Subsequently, for an intermediate discharge capacity complying with a thermal load, the high-pressure side communication hole 62 (high-pressure side passage 43) of the first control valve 50 is opened and the low-pressure side communication hole 59 (low-pressure side passage 44) of the same is closed in accordance with the amount of power supply to the exciting coil and the pressure in the low pressure chamber that the diaphragm 70 receives as illustrated in FIG. 6(*a*). The high-pressure gas in the discharge chamber 34 is then supplied to the control pressure chamber 4 and also to the back pressure chamber 48 via the air-supply chamber 40 and, when a force applied to the spool 47 by the high-pressure gas supplied to the back pressure chamber 48 exceeds a sum of the force based on the pressure in the control pressure chamber 4 and a biasing force of the biasing means (compression spring 49), the spool 47 moves against a biasing force of the biasing means (compression spring 49) and closes the first bleed passage 42.

Therefore, as the high-pressure gas is supplied to the control pressure chamber 4 via the supply passage 40 with the first bleed passage 42 blocked, the pressure in the control pressure chamber 4 increases, and the piston stroke (discharge amount) decreases.

When decreasing the power of the compressor by minimizing the discharge capacity of the compressor for the reason of sudden acceleration of the vehicle or the like, the first valve portion of the first control valve opens the high-pressure side passage 62 (high-pressure side passage 43) by discontinuing the power supplied to the first control valve 50. Accordingly, the back pressure chamber 48 is maintained to communicate with the discharge chamber 34 via the first control valve 50, and thus the closed state of the first bleed passage 42 is maintained (see FIG. 6(*a*)). Accordingly, the refrigerant introduced into the control pressure chamber 4 does not leak into the inlet chamber 33, so that the discharge capacity of the compressor may be decreased only with an introduction of the minimum refrigerant gas.

Subsequently, for increasing (restarting) the discharge capacity of the compressor, an electric power is supplied to the first control valve 50, and the high-pressure side communication hole 62 (high-pressure side passage 43) is closed, and the low-pressure side communication hole 59 (low-pressure side passage 44) is opened as illustrated in FIG. 6(*b*), so that the back pressure chamber 48 of the second control valve 45 is connected to the inlet chamber 33 via the first control valve 50.

Accordingly, as the back pressure chamber 48 communicates with the inlet chamber, the high-pressure gas retained in the back pressure chamber 48 may be discharged into the inlet chamber 33 via the first control valve 50, so that the spool 47 moves in an opening direction by the biasing force of the biasing means (compression spring 49) to bring the first bleed passage 42 into the opened state.

Therefore, the pressure in the control pressure chamber 4 may be released to the inlet chamber 33 in a rapid manner via the second bleed passage 41 and the first bleed passage 42, and the discharge capacity at the time of restarting may be increased in a rapid manner.

In this manner, as opening-closing control of the first bleed passage 42 may be achieved by selectively causing the back pressure chamber 48 of the second control valve 45 to communicate with the discharge chamber 34 or the inlet chamber 33 via the first control valve 50, the start-up performance of the compressor (start-up performance not only at the time of cold start, but also at the time of restart) may be enhanced, and the internally circulating refrigerant at the time of intermediate stroke may be reduced.

In the above-described configuration, as a fixed throttle 2*b* is provided at a position on a downstream side of a position where the back pressure chamber 48 of the supply passage 40 is connected, if the back pressure chamber 48 is connected to the discharge chamber 34 via the first control valve 50 with the first bleed passage 42 in the opened state, the pressure on the upstream side of the fixed throttle (pressure in the back pressure chamber) may be increased in a rapid manner to ensure closing of the first bleed passage 42 by the spool 47.

Figure 7:
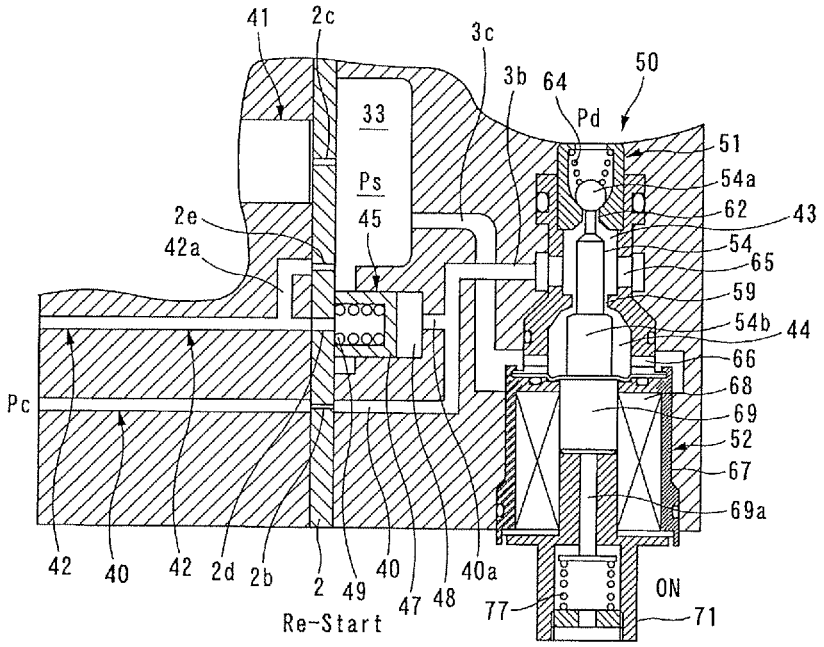
FIG. 7 illustrates a modification of the configuration in FIG. 5.
Figure 8:
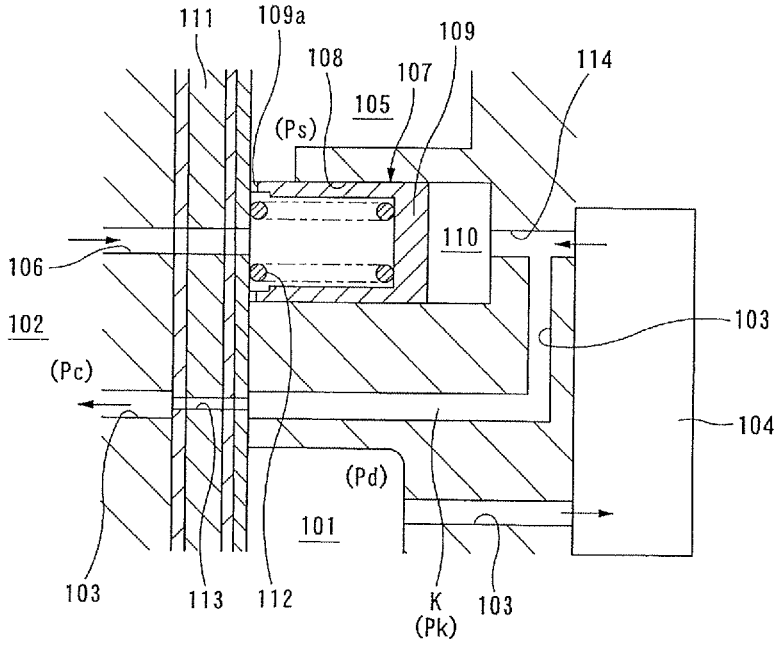
FIG. 8 illustrates a configuration of a variable capacity compressor proposed in the related art.

In contrast to the configuration described above, a bypass passage 42*a* which bypasses the second control valve 45 and is connected to the inlet chamber 33 may be connected to the first bleed passage 42 and the bypass passage 42*a* may be provided with a fixed aperture (orifice hole) 2*e* as illustrated in FIG. 7.

This configuration ensures a circulation of the smallest amount of a refrigerant gas in the control pressure chamber via the fixed throttle 2*e* in the bypass passage 42*a* even though the supply passage 40 is opened by the first control valve 50 and the first bleed passage 42 is closed without the second bleed passage 41. When the back pressure chamber 48 communicates the inlet chamber 33 via the first control valve 50, the refrigerant in the control pressure chamber 4 may be released to the inlet chamber 33 via the fixed throttle 2*e* in the bypass passage 42*a* in addition to the bleed via the second bleed passage 41 and the bleed via the second control valve 45, so that the pressure in the control pressure chamber 4 may be lowered in a rapid manner.

In the configuration example described thus far, the first bleed passage 42 is provided in addition to the second bleed passage 41. However, a configuration including only the first bleed passage 42 which is opened and closed by the above-described second control valve 45 described above without providing the second bleed passage 41 is also applicable. In this case, a fixed throttle which allows a flow of a small amount of refrigerant may be provided in the second control valve 45 for opening and closing the first bleed passage 42.

REFERENCE SIGNS LIST

2*b* fixed throttle
2*e* fixed throttle
4 control pressure chamber
7 drive shaft
20 swash plate
23 compression chamber
33 inlet chamber
34 discharge chamber
40 supply passage
41 second bleed passage
42 first bleed passage
42*a* bypass passage
45 second control valve
46 spool housing recess
47 spool
48 back pressure chamber
49 compression spring
50 first control valve

The invention claimed is:

1. A variable capacity compressor comprising:

a compression chamber configured to compress a working fluid;

an inlet chamber configured to house the working fluid to be compressed in the compression chamber;

a discharge chamber configured to house the working fluid compressed in the compression chamber and discharged therefrom;

a control pressure chamber including a drive shaft penetrating therethrough and configured to house a swash plate rotating in accordance with a rotation of the drive shaft;

a supply passage configured to facilitate communication between the discharge chamber and the control pressure chamber;

a bleed passage configured to facilitate communication between the control pressure chamber and the inlet chamber;

a first control valve including a first valve portion configured to adjust an opening degree of the supply passage;

a second control valve provided on the bleed passage and comprising a spool housing recess formed on the bleed passage, wherein a spool housed in the spool housing recess is configured to be movable to open and close the bleed passage;

a back pressure chamber disposed in between the spool and a bottom of the spool housing recess; and biasing means configured to bias the spool in an opening direction of the bleed passage, wherein the supply passage is connected to the back pressure chamber on the downstream side of the first valve portion of the first control valve to open and close the bleed passage based on a pressure in the back pressure chamber, wherein the first control valve further comprises:

a low-pressure side passage branched from the supply passage at a point downstream of the first valve portion and communicating with the inlet chamber, and a second valve portion configured to adjust an opening degree of the low-pressure side passage, wherein the first valve portion and the second valve portion are in an interlocked relationship such that when one of the first and second valve portions closes a corresponding passage, the other of the first and second valve portions opens the corresponding passage, and wherein the back pressure chamber is selectively connected to the discharge chamber or the inlet chamber via the first valve portion or the second valve portion of the first control valve.

2. The variable capacity compressor according to claim 1, wherein the back pressure chamber is connected to the inlet chamber via the second valve portion of the first control valve for activating the compressor.

3. The variable capacity compressor according to claim 1, wherein the supply passage is provided with a fixed throttle at a position on a downstream side of a position where the back pressure chamber is connected.

4. The variable capacity compressor according to claim 3, wherein a bypass passage which bypasses the second control valve and is connected to the inlet chamber is connected to the bleed passage, and the bypass passage is provided with a fixed throttle.

5. The variable capacity compressor according to claim 1, wherein a bypass passage which bypasses the second control valve and is connected to the inlet chamber is connected to the bleed passage, and the bypass passage is provided with a fixed throttle.

* * * * *